United States Patent [19]

Blackall et al.

[11] 4,330,976

[45] May 25, 1982

[54] PACKING MACHINES

[75] Inventors: Victor G. Blackall; Robert T. Daisley, both of London, England

[73] Assignee: Molins Limited, London, England

[21] Appl. No.: 190,523

[22] PCT Filed: Jul. 5, 1979

[86] PCT No.: PCT/GB89/00115

§ 371 Date: Feb. 21, 1980

§ 102(e) Date: Feb. 21, 1980

[87] PCT Pub. No.: WO80/00246

PCT Pub. Date: Feb. 21, 1980

[30] Foreign Application Priority Data

Jul. 11, 1978 [GB] United Kingdom ..... 29393/78

[51] Int. Cl.[3] ..... B65B 19/04; B65B 19/24

[52] U.S. Cl. ..... 53/151; 53/234; 53/575

[58] Field of Search ..... 53/148, 149, 150, 151, 53/225, 170, 234, 575; 198/420, 485, 540, 412, 480

[56] References Cited

U.S. PATENT DOCUMENTS

| | | | |
|---|---|---|---|
| 1,608,163 | 11/1926 | Bronander | 53/151 |
| 1,942,885 | 1/1934 | Tevander | 53/282 X |
| 2,603,483 | 7/1952 | Fischer . | |
| 3,106,282 | 10/1963 | Schmermund | 198/420 |
| 3,590,556 | 7/1971 | Folke | 53/575 |
| 3,805,477 | 4/1974 | Kruse | 53/234 |
| 3,922,837 | 12/1975 | David | 53/234 |
| 4,148,170 | 4/1979 | Gaubert | 53/232 X |
| 4,150,520 | 4/1979 | Palmieri | 53/234 |

FOREIGN PATENT DOCUMENTS

| | | | |
|---|---|---|---|
| 2107744 | 9/1971 | Fed. Rep. of Germany | 53/234 |
| 2244533 | 4/1974 | Fed. Rep. of Germany | 53/229 |
| 2267932 | 11/1975 | France | 53/234 |
| 814369 | 6/1959 | United Kingdom | 53/234 |

*Primary Examiner*—John Sipos

*Attorney, Agent, or Firm*—John C. Smith, Jr.

[57] ABSTRACT

A packing machine has a main rotor (104) carrying hollow mandrels (141) to which foil and paper blanks are fed by respective feed units (160, 170) and folding-/tucking devices to produce a packet with one end closed on each mandrel successively. Groups of cigarettes are fed to the mandrels from a twin-delivery hopper (110, 111, 112) the two deliveries (111, 112) of the hopper serving alternate pockets (121) of a single conveyor drum (102) which carries the groups towards the main rotor (104), a transfer drum (103) taking adjacent groups two at a time from the conveyor drum (102) to the rotor (104) and compressing each group during transfer. Each packet is removed from its mandrel (by pushing the cigarettes against the closed end of the packet) into a further drum (105) on which the second end of the packet is closed and adhesive securing folds of the packet completes its drying. The packet is then discharged through a stamper unit (106).

13 Claims, 5 Drawing Figures

PACKING MACHINES

This invention relates to machines for packing rod-like articles such as cigarettes and more particularly, although not necessarily exclusively, to machines for packing such articles in the type of packet known in the cigarette trade as a "soft pack". This type of packet most commonly consists of a plain rectangular blank of metallic foil folded around a group of cigarettes in the form of a tube of generally rectangular section, with both ends closed by tucking and folding, and with a somewhat shorter printed paper blank similarly folded outside the foil to cover all but one end of said foil. The folded foil at the exposed end is secured by a superposed securing strip of paper (often constituting a revenue stamp), overlaps elsewhere being secured by adhesive, and usually an overwrap of transparent material is applied to enclose the whole pack.

Packing machines for producing such soft packs commonly include a plurality of hollow rectangular-section mandrels each adapted to receive internally a group of cigarettes. Foil and paper blanks are successively applied to and folded around each mandrel to form a packet with a closed bottom and open top, the packet then being separated from the mandrel by pushing a group of cigarettes out of the mandrel so that the cigarettes engage the closed bottom of the packet as they are leaving the mandrel; the packet thus leaves the mandrel with the cigarettes inside it and thereafter the top of the packet is closed by tucking and folding, the closure strip is applied and any desired overwrap is applied. It is a common practice to compress the group of cigarettes prior to their insertion into the mandrel; then as the cigarettes and packet leave the mandrel the cigarettes expand slightly to fit the packet.

Such machines are now required to operate at quite high output rates, in excess of 200 packets per minute. Some parts of such machines can readily be operated at the speeds necessary for such output rates, but other parts (in general those in which articles are fed by gravity and/or reciprocating elements presenting inertia problems) are difficult to operate.

According to the invention, we provide a packing machine for rod-like articles such as cigarettes, comprising:

a hopper for assembling articles into groups, each containing a desired number of articles;

a rotatable member carrying a plurality of hollow mandrels at regularly spaced positions around its circumference;

means for supplying packet blanks to each of said mandrels in succession and folding said blanks around said mandrels to form open-ended packets;

an endless conveyor having a plurality of spaced tubular pockets for transporting groups of articles from the hopper towards the rotatable member;

and transfer means for receiving groups two at a time successively from the pockets of the conveyor and inserting said groups two at a time successively into the mandrels, comprising at least one rotatable drum having a plurality of regularly-spaced chambers for carrying said groups;

said hopper, said rotatable member, said conveyor and said transfer means all being arranged to operate intermittently, so that said rotatable member at regular intervals moves through an angle equal to the angular spacing between the centres of adjacent mandrels;

said conveyor advances by a distance equal to the spacing between the axes of one pocket and the axis of the next-but-one pocket at every second movement of said rotatable member;

said hopper delivers two groups of articles to respective pockets of the conveyor during each stoppage of said conveyor; and each said drum of the transfer means moves through an angle equal to twice the angular spacing between the centres of adjacent chambers for every two movements of said rotatable member.

In such a machine, the hopper and the conveyor are required to operate at one-half of the speed (more accurately, the frequency) of the other elements, for any given output rate. Thus a high output rate is attainable, in spite of the facts that in the hopper, cigarettes are gravity-fed and that the conveyor has substantial inertia. The drum or drums of the transfer means may be arranged to compress the cigarette groups during transfer, and a further conveyor may be provided to receive part-formed packets containing cigarettes from the mandrels of the rotatable member successively, means associated with said further conveyor being arranged to complete the formation of the packets.

The conveyor and further conveyor may be endless belts carrying regularly-spaced pockets, but are preferably also in the form of drums. The transfer means may comprise two drums, each receiving and delivering one group of articles at a time so that the two transfer drums, operating in synchronism, together deliver two groups at a time to mandrels of the rotatable member; preferably however a single transfer drum is provided, arranged to receive two groups simultaneously in adjacent chambers and to deliver two groups simultaneously from adjacent chambers.

The blank supplying means may comprise first and second feed means respectively supplying sheets of inner and outer wrapping material, the second feed means supplying a sheet of outer wrapping material to each of the mandrels of the rotatable member after a sheet of inner wrapping material has been at least partly folded around the mandrel. One or both of said feed means may be a dual feed unit.

In order that the invention may be well understood, two forms of machine embodying the invention will now be described, referring to the accompanying diagrammatic drawings, in which.

Figure 1:
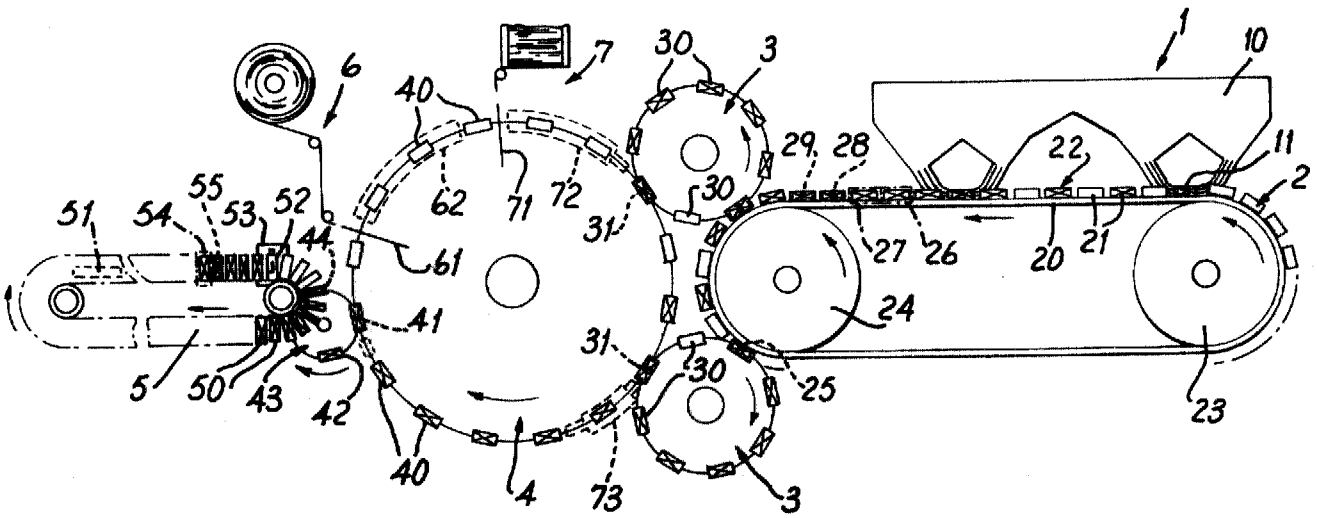
FIG. 1 is an elevation of one form of machine.

First referring to FIG. 1, the machine shown has a hopper 1, a cigarette conveyor 2, two transfer drums 3, a packet forming rotor 4, and a packet conveyor 5. The hopper 1 has a cigarette reservoir 10 supplying two delivery assemblies 11, 12 each arranged to deliver a succession of groups of cigarettes, arranged in three rows respectively containing seven, six and seven cigarettes.

The conveyor 2 is in the form of an endless belt or chain 20 carrying a succession of regularly-spaced pockets 21, and is intermittently driven. Each movement of the conveyor 2 advances it (its upper run 22 moving to the left) by a distance equal to twice the pocket spacing (i.e. the distance between the centres of adjacent pockets 21). The delivery assemblies 11, 12 of the hopper 1 are spaced apart by seven times the pocket-spacing, and each time the conveyor 12 is stationary, each said assembly has one of the pockets 21 in register with it and delivers a group of cigarettes into that pocket. As the assemblies 11, 12 are seven pocket spacings apart while each movement of conveyor 2 is through a distance of two pocket spacings, it will be clear that a pocket 21 which receives a group of cigarettes from the upstream assembly 11 will not stop in register with the downstream assembly 12 hence successive pockets are filled by groups from assembly 11 and from assembly 12 alternately.

The conveyor 2 is carried by sprockets 23, 24 at the upstream (right-hand) and downstream (left-hand) ends of the upper run respectively. As the pockets 21 travel from the downstream delivery assembly 12 towards the sprocket 24, each pocket should contain a group of twenty cigarettes. At one and two pocket spacings to the left of assembly 12, two ends-detector units 26, 27 are provided; these units may be of any of the known types and operate while the conveyor 2 is stationary, to sense that a group of twenty cigarettes is present in each of two adjacent pockets and that the ends of the cigarettes are sufficiently firm. If a fault is found by either of said detector units 26, 27 a fault signal is passed to a respective rejector unit 28 or 29; these units 28, 29 are respectively three and four pocket spacings to the left of assembly 12 so that, after the groups in two adjacent pockets 21 have been sensed by detector units 26, 27, the next movement of the conveyor 2 brings the same two pockets into register with units 28, 29. If either unit 26, 27 sensed a fault then (after said next movement of conveyor 2) the corresponding rejector unit 28, 29 operates to remove the faulty cigarette group from the appropriate pocket 21, the group being kept in its assembled condition. Adjacent to the sprocket 24, the transfer drums 3 are mounted. Each of the drums 3 has eight chambers 30, each designed to receive one group of cigarettes. The chambers 30 are regularly spaced round the drum, and the latter rotates intermittently in 45° steps. As seen in the drawing, the upper drum 3 rotates anticlockwise and the lower drum 3 rotates clockwise. Every time the drums 3 are stopped, one of the chambers 30 of each drum 3 is in alignment with one of the pockets 21 of conveyor 2, and during this stoppage period, pushers 25 behind the plane of the drawing enter the pockets 21 which are thus aligned so that the cigarette groups are transferred from those pockets into the adjacent chambers 30.

After the drum has advanced six steps (i.e. has made three-quarters of a revolution) from the position at which any particular pair of chambers 30 of the two drums 3 have thus each received a group of cigarettes, the drums are stopped with those chambers in alignment with respective ones of a plurality of hollow mandrels 40 carried by the pocket-forming rotor 4 at positions regularly-spaced around its circumference. During this stoppage period, pushers 31 behind the plane of the drawing come forward through the chambers 30, pushing the cigarette groups into the aligned mandrels 40. Each of the mandrels 40 in which the groups are received already carried an open-ended packet (the open ends of such packets being of course directed towards the aligned chamber 30 of drums 3).

The rotor 4 has sixteen of the mandrels 40, each of substantially rectangular section, open at both ends, and mounted so that its axis is parallel to the rotational axis of the rotor. Said rotor 4 advances intermittently in a clockwise direction, each step of rotary movement being of 22½°. Before each mandrel 40 reaches the region in which the drums 3 are placed, the mandrel stops first in the vicinity of a foil feed unit 6 which, while the mandrel is stationary, feeds a foil blank 61 (cut from continuous web) to the mandrel; the mandrel, with the foil blank, advances past conventional folders and tuckers which cause the foil blank 61 to be wrapped around the mandrel to form a rectangular-section tube with a small overlap, and close one end of such a tube by tucking and folding. Said tuckers and folders are of any convenient known form and are located in the region indicated at 62 through which the mandrel passes during the next two advancing steps of the rotor 4 after feed of the foil to the mandrel. On completion of the third step, the mandrel, carrying the foil, stops in the vicinity of a paper feed unit 7 which supplies a precut paper blank 71 to the mandrel and in the next two advancing steps of the rotor 4, the paper blank passes through a region 72 in which folders and tuckers cause the paper to be folded around the mandrel and its end partly closed to form an outer wrapper surrounding the foil. It is noted that when the paper blank 71 is supplied to the mandrel, the folding of the foil is incomplete in one respect; small ears 63 of foil, projecting from the shorter sides of the end being closed, are not folded down; the folding of these is accomplished when the end of the paper blank is closed; in the case of the paper, tuckers push down the paper along the narrow sides of the end first, with the foil ears 63 underneath. In forming the end of the foil blank before application of the paper, the foil is folded down only along the long sides of the end, so that the ears 63 are formed but left projecting. It will be seen that this effects an economy in the number of folding devices needed.

The upper one of the two transfer drums 3 and its associated pusher 31 deliver a group of cigarettes into each alternate mandrel 40 when the latter has advanced three steps from the position at which the paper blank 71 is supplied to the mandrel. At this position the folding of the end of the paper blank has not been done, but this is immaterial; their folding is completed in a region indicated at 73. The lower drum 3 and its pusher 31 deliver a group of cigarettes into each remaining mandrel when the latter has advanced six steps from the position at which the paper is supplied, and the two pushers 31 operate simultaneously, the said pushers operating during each second stoppage period of the rotor 4.

After each mandrel 40 leaves the position at which it is aligned with the pusher 31 associated with the lower drum 3, it advances in steps carrying the open-ended foil and paper packet on its exterior, and the cigarette group inside it, to a position (just before it reaches the vicinity of the foil feed unit 6) at which it is transferred to one of a plurality of regularly-spaced pockets 50 of the packet conveyor 5. While the mandrel 40 is stopped, a pusher 41 comes forward into the mandrel 40 and pushes the group of cigarettes into one of four chambers 42 of a transfer drum 43. As the cigarettes leave the mandrel 40, they engage the closed end of the packet and strip it off the mandrel 40 to enter the chamber 42 with the cigarettes.

A spring-loaded movable plate (not shown) is provided to abut the closed end of the packet as it leaves the mandrel 40, to reduce the chance that the bottom flaps may open.

Drum 43 advances in 90° steps in synchronism with movements of rotor 4, and after three steps of drum 43, a pusher 44 transfers the filled pocket from chamber 42 to one of the pockets 50.

It is here noted that the transfer drums 3 also serve as compression drums; each of their chambers 30 has movable walls which in known manner close together slightly while the chamber moves from the position at which each cigarette group enters the chamber to that at which it leaves the chamber; the compression is partially released just before each group is transferred by pusher 31. The interior of each mandrel 40 is of such size as to maintain the compression thus applied to the cigarette groups, but when the cigarettes and the associated packet leave the mandrel 40, the compression is released and the cigarettes expand slightly to fit the packet snugly. The pockets 50 are of such size as to receive the packets without deformation but without permitting perceptible lateral movement of the packets relative to their respective pockets.

The conveyor 5 also advances intermittently in a clockwise direction, and brings each packet in succession to a region indicated at 51 in which conventional tuckers and folders are provided to close the second end of the packet. The paper blank 71 is shorter than the foil blank 61, extending from the first-closed end of the packet the length of a cigarette, or slightly less, so that in closing the second end of the packet (the top end of the finished packet) only foil has to be folded and tucked. After passing the region 51, each packet 50 moves in a number of steps to a position indicated at 52, at which a pusher (not shown, as when not operating it is in front of the plane of the drawing) pushes the packet out of the pocket 50 towards a conventional mechanism indicated diagrammatically at 53 for applying a top end closure seal, such as a revenue stamp, which may be precut or cut from a continuous web. If desired, a packet inspection device 54 may be associated with conveyor 5, and when a fault is detected, the application of the stamp or other seal may be prevented and the packet ejected at 55.

To avoid waste of material, it is desirable to avoid feeding of the foil and paper blanks corresponding to a group of cigarettes which are faulty and are rejected as a result of sensing by one of the ends detectors 26, 27. When either of said detectors detects a fault in a cigarette group, therefore, a fault signal from the respective detector is directed to a storage device (not shown) which, at an appropriate later time, emits a signal to the foil feed unit 6 to prevent feeding of a foil blank to one of the mandrels 40, and, later again, similarly prevents feed of a paper blank from the unit 7. By this means no foil or paper is applied to the mandrel 40 which would have received the faulty group of cigarettes if that group had not been rejected.

It will be noted that the length of the conveyor 5 is such as to allow sufficient drying time for the adhesive securing the various parts of the packet to complete its drying.

Various changes may be made in the machine described, e.g. the paper blanks need not be precut but may be cut from continuous web as required.

Figure 2:
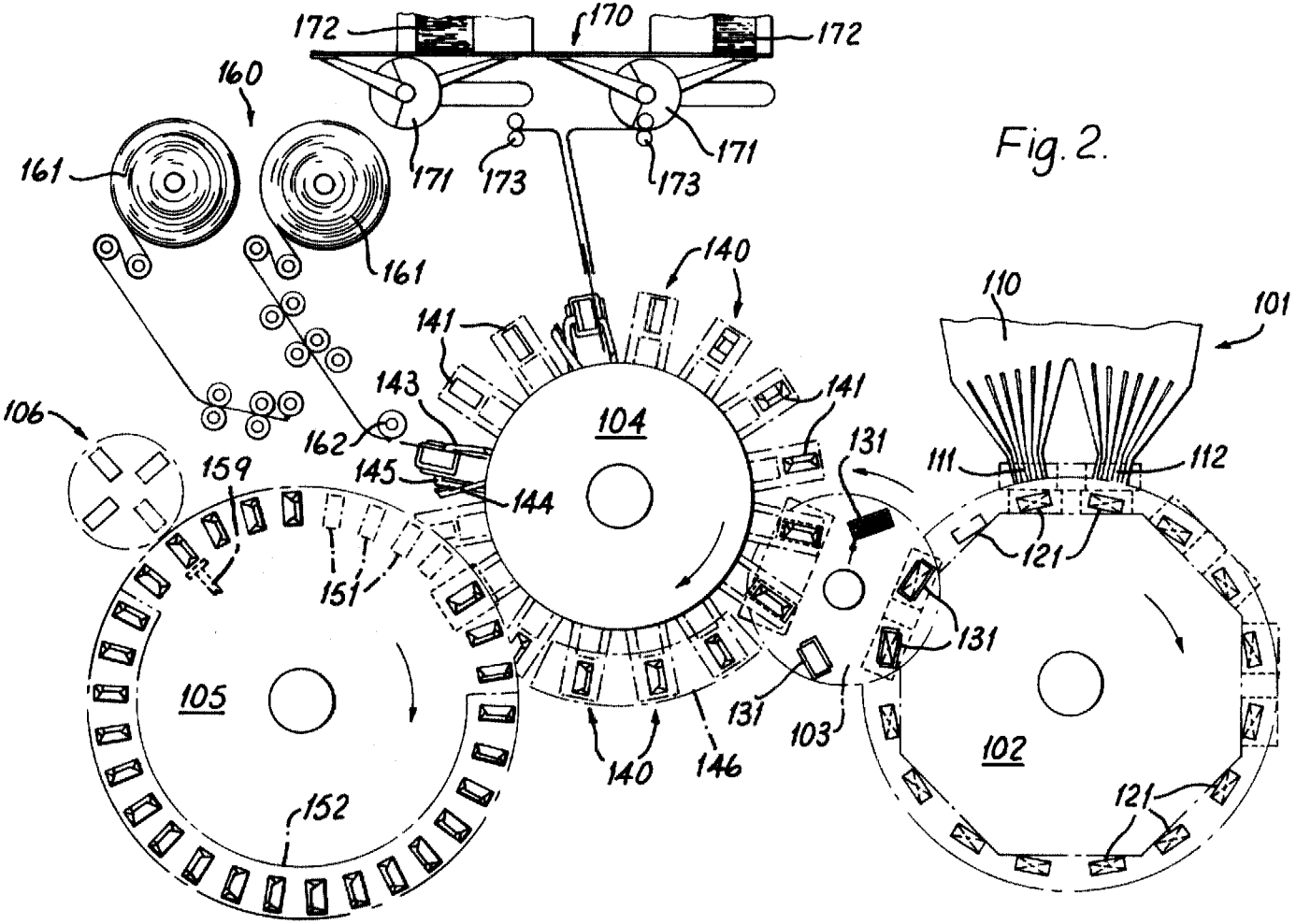
FIG. 2 is a similar view of a preferred form of machine.
Figure 3:
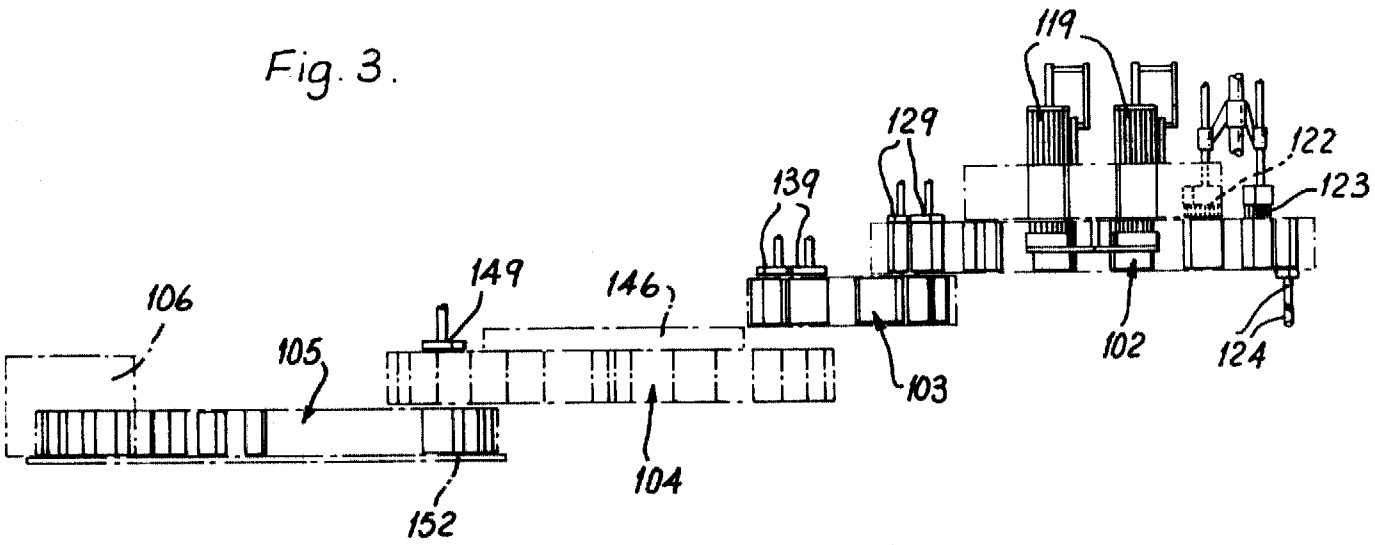
FIG. 3 is a partial plan view of the machine of FIG. 2.

Referring now to FIGS. 2 and 3 the machine embodying the invention illustrated in these figures comprises a hopper 101, a conveyor drum 102, a single transfer drum 103, a packet forming rotor 104, and a packet finishing drum 105. The hopper 101 has a cigarette reservoir 110 supplying two delivery assemblies 111, 112 each arranged to deliver a succession of groups of cigarettes, each group again being arranged in three rows respectively containing seven, six and seven cigarettes.

The drum 102 is intermittently driven and of generally octagonal form having rectangular pockets with their larger sides being disposed substantially tangentially with respect to a circle concentric to the axis of the drum. The drum carries two pockets 121 on each of its eight faces, the two pockets on each face being tilted away from one another slightly. Each time the drum 102 is moved, it rotates through one-eighth of a revolution. The hopper delivery assemblies 111, 112 are spaced apart by a distance equal to that between adjacent pockets 121 and are tilted slightly to match the disposition of the pockets on each face of the drum; each time the drum 102 is stationary, the respective assemblies 111, 112 deliver a group of cigarettes into each of the two pockets 121, on one face of the drum 102.

The hopper delivery assemblies 111, 112 are preferably each of the form in which cigarettes descend under gravity in seven channels defined by vertical separating vanes, with horizontal pushers 119 operating across the bottom of each channel to remove, with each forward stroke of said pushers, two cigarettes from one channel and three cigarettes from each of the other six channels, and with lowering vanes which support the cigarettes above those being removed by the pushers until the latter have reached a position at which the cigarettes above the level of the pushers may be allowed to descend. (Such a hopper delivery assembly is disclosed in British patent specification No. 1,524,843.) In the present machine the lowering vanes are driven by means including a clutch which may be disengaged (with the vanes raised) when a fault in some other part of the machine makes it necessary to interrupt feed of cigarettes from the hopper 1 to the pockets 121.

The hopper delivery assemblies push each group of cigarettes parallel to the rotational axis of drum 102, and each pocket 121 has a somewhat greater width at the side facing the hopper than along the majority of its length; thus as the cigarettes of each group enter a pocket 121 their leading ends are guided by convergent sections of the pocket walls, to bring the cigarettes into contact, each with the next, removing the spacing between adjacent cigarettes due to the vanes defining the vertical channels from which the cigarettes have been pushed.

When two adjacent pockets 121 have each received a group of cigarettes and the drum 102 has made one movement, the two adjacent pockets are at positions at which are located conventional "ends detectors" 122, 123 whose function is to sense whether the ends of all the cigarettes are sufficiently filled with tobacco (or contain a filter plug, as the case may be); such detectors also sense if any cigarettes are missing from a group, and emit a fault signal whenever a cigarette's end is too soft (or a filter plug, or a complete cigarette, is missing). Each such fault signal is stored in known manner and serves when the faulty group reaches a rejection position 124, to cause that group of cigarettes to be ejected from its pocket 121.

Although the hopper delivery assemblies 111, 112 deliver two groups of cigarettes to the two pockets 121 on each face of the drum simultaneously, those two groups are not removed from the drum 102 at the same time. Removal of each group occurs when its pocket 121 is stopped in alignment with one of six chambers 121 in drum 103, and on each stoppage of the drums, the pocket 121 on the trailing portion of one face of drum 102, and the pocket 121 on the leading portion of the next face, are in alignment with two adjacent chambers 131 of drum 103, and pushers 129 (FIG. 3) expel the groups of cigarettes from these two pockets 121 into the aligned chambers 131. At the same time, another two adjacent chambers 131 are in alignment with two adjacent hollow mandrels 141 which are carried by the packet forming rotor 104.

The rotor 104 carries sixteen packet forming assemblies 140 and each of said assemblies includes a mandrel 141. Each mandrel 141 is a tubular member of generally rectangular section, but with rounded corners, and is of such size that its interior is slightly smaller than that of an uncompressed group of twenty cigarettes arranged in three rows, a middle row of six cigarettes and two outer rows each of seven cigarettes. In the chambers 131 of drum 103, each group of cigarettes is compressed slightly while the drum is moved from the position at which that chamber receives the group from a pocket 121 of drum 102 to the position at which that pocket is aligned with one of the mandrels 141. While the drum 103 and rotor 104 are stationary, pushers 139 propel the cigarette groups from two of the chambers 131 into aligned mandrels 141, the slight compression of each group being sufficient to reduce the overall size of the group to permit its entry into the mandrel 141.

At the position where mandrels 141 receive cigarette groups as just described, the exterior of each mandrel carries a packet with one end open to permit entry of the cigarettes into the mandrel, and the other end closed. The packet is formed from a sheet of metallic foil and a sheet of paper, termed a "label". A foil feed assembly 160 mounted adjacent to the rotor 104 is arranged to supply a succession of cut sheets of foil, one such sheet being fed across one face of one of the mandrels 141 during each stoppage period of the intermittently-driven rotor 104. A foil clamp 143 moves towards the mandrel 141 as the foil sheet reaches it to retain the foil sheet in contact with the mandrel and during susequent movements and stoppages of the rotor 104, stationary and moving folders first cause the foil sheet to be folded into a tube surrounding the mandrel 141, and then cause one of its end portions (which protrudes beyond the end of the mandrel) to be tucked and folded to close the end of said tube, and of the mandrel. Thus further clamps 144, 145 operate to hold the foil to the mandrel at different stages of the folding process. Before the one end of the foil sheet is tucked and folded, a printed paper label is fed to the mandrel 141 by a label feed unit 170. The clamps 143, 144, 145 and the fixed and moving folders form the label into a tube around the mandrel 141, outside the foil, and one of its end portions overlies and is folded with the protruding end portion of the foil sheet.

When each mandrel 141 has received both the foil and the label, the folding and tucking of the foil and label having produced a packet, with one end closed and the other end open, on the mandrel, and a group of cigarettes having been pushed into that mandrel from a chamber 131 of the drum 103, successive movements of the rotor 104 take the mandrel 141 past a final stationary folder 146 which folds down an outermost large flap of the end of the packet and holds it down through several movements of the rotor 104. The folder 146 is heated for dry adhesive securing the end folds of the packet, such adhesive having been applied to appropriate areas of the foil sheet and label as they were fed to the mandrel 141 by the foil feed assembly 160 and the label feed unit 170 respectively.

After moving clear of the folder 146, each mandrel 141 reaches a position at which it stops in alignment with a pocket 151 of the drum 105. Said drum 105 has thirty such pockets, and as each stops in alignment with one of the mandrels 141, a pusher 149 expels the group of cigarettes from the mandrel 141 and inserts said groups in the pocket 151; the pusher enters the mandrel 141 at the end at which the packet is open and as the cigarettes move out of the mandrel they engage the closed end of the packet and push it into the pocket 151 so that on completion of the forward stroke of the pusher, the pocket 151 contains the packet, with the group of cigarettes inside the packet. The pocket 151 is of such depth that the body of the packet is just accommodated within the pocket, the end portion of the foil sheet which is to be folded to close the second end of the packet protruding from the pocket. It will be appreciated that the adjacent ends of the mandrel 141 and the pocket 151 must be spaced apart, at the position of such transfer, so that when the rotor 104 and drum 105 next move the protruding foil is not disturbed by engagement with the end of the mandrel 141.

As the drum 105 moves intermittently, in steps equal to the spacing between adjacent pockets 151, each packet placed in one of the pockets 151 is moved past a heater 152 which completes the drying of the adhesive securing the closed end of the packet. Each time that the drum 105 is stationary the heater 152 is in contact with the closed ends of the packets in eighteen of the pockets 151, but when the drum 105 is about to move, the heater 152 is moved (parallel to the axis of the drum 105) out of contact with the ends of the packets, being moved back into contact with said ends as soon as each movement of the drum 105 is completed; this movement of the heater 152 is not large, it is sufficient to give a clearance of about 1 mm between the heater and the packet ends whilst the drum 105 is moving. As the closed end of each packet is moving intermittently through the zone in which the heater 152 is located, the open end of the packet, at the other end of the pocket 151, is being closed by fixed and moving folders (not shown). No adhesive is applied to the end portion of the foil sheet which is thus closed, as upon ejection from the pocket 151 each packet is fed to a stamping unit 106 which applies a narrow closure strip (often in the form of a revenue stamp), coated with adhesive, across the narrow dimension of the end of the packet and part-way down its sides. Delivery of the packet from each pocket 151 is effected by a pusher 159 moving radially of the drum 105; the pusher 159 is carried in fixed supports within the drum 105 and is moved radially outward through whichever pocket 151 is at the delivery position each time the drum 105 stops.

It should be noted that while the drum 105 operates at the same speed as the packet-forming rotor 104, in terms of movements per unit time, the drum 102 and drum 103 both operate at half this speed (again in terms of movements per unit time). However, as the drums 102 and 103 are required to provide a group of cigarettes for each mandrel on the rotor 104, this is achieved by arranging that both the drum 102 and the drum 103, when they move, turn through a distance equal to the spacing between one pocket and the next-but-one pocket, and whenever they are stationary, two groups of cigarettes are transferred from adjacent pockets of drum 102 to adjacent chambers of drum 103, and two groups of cigarettes are transferred from adjacent chambers of drum 103 to adjacent mandrels on rotor 104. This arrangement allows the drum 102, each time it stops, to remain stationary for a period more than twice as long as the period of each stop of the rotor 104, giving sufficient time for the cigarette groups to be formed and fed into the pockets 121. It is well known that the cigarette hopper of a packing machine, with a delivery assembly having the conventional arrangement of gravity feed of the cigarettes down between vanes and reciprocating pushers between the lower ends of the vanes, is limited in its output rate due to the inertia of the pusher and the relatively low downward acceleration of the cigarettes between the vanes. The maximum output rate, for groups of twenty cigarettes in a three-row arrangement, from a hopper delivery assembly is of the order of 200 groups per minute so that the two assemblies 111, 112 of the machine of FIG. 2 can deliver, therefore, an output of the order of 400 groups per minute. Such a speed can be expected of the rotor 104, drum 105 and stamping unit 106 which need not therefore be duplicated.

The foil feed assembly 160 and the label feed unit 170 are both double units, in different senses. The assembly 160 carries two foil reels 161 from each of which a web of foil can be fed to a common rotary cutter 162, the foil from the respective reels being fed along separate paths to a junction point just upstream of said cutter 162. In normal operation, foil from one of the reels is fed to the cutter and successive sheets produced by said cutter are fed on to successive mandrels 141. While the foil from one of the reels is thus being used, the other reel is waiting to be used, the free end portion of the foil web from said other reel being threaded along the respective web path to a datum position just before said junction point of the web paths. When a detector (not shown) senses that the one reel is almost exhausted, feed of the web from that reel is stopped and feed from the other reel is started, the changeover being so timed relative to the cutter operation that the feed of sheets from the cutter is not interrupted. The one reel, now exhausted, is then replaced by a full reel and the end portion of the foil web from the full reel is led to a similar datum position just before said junction point in readiness for a further changeover.

In contrast, the label feed unit 170 has two suction feed rollers 171 which roll and reciprocate across the bottom of respective label stacks 172, each roller removing the lowest label from its respective stack as that roller is moving inwards i.e. towards the other stack. The labels are delivered by the rollers 171 to respective pairs of feed rollers 173 and then deflected downwards into a common feed path—as the labels are printed, it will be noted that the labels in one stack 172 have to be arranged with their printed face upwards, and in the other stack the printed faces have to be downwards, so that in the common feed path all the labels have their printed faces in the same direction.

Figure 5:
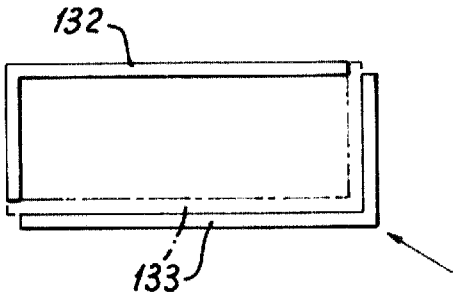
FIGS. 4 and 5 are detail views of parts of the machine of FIG. 2.
Figure 4:
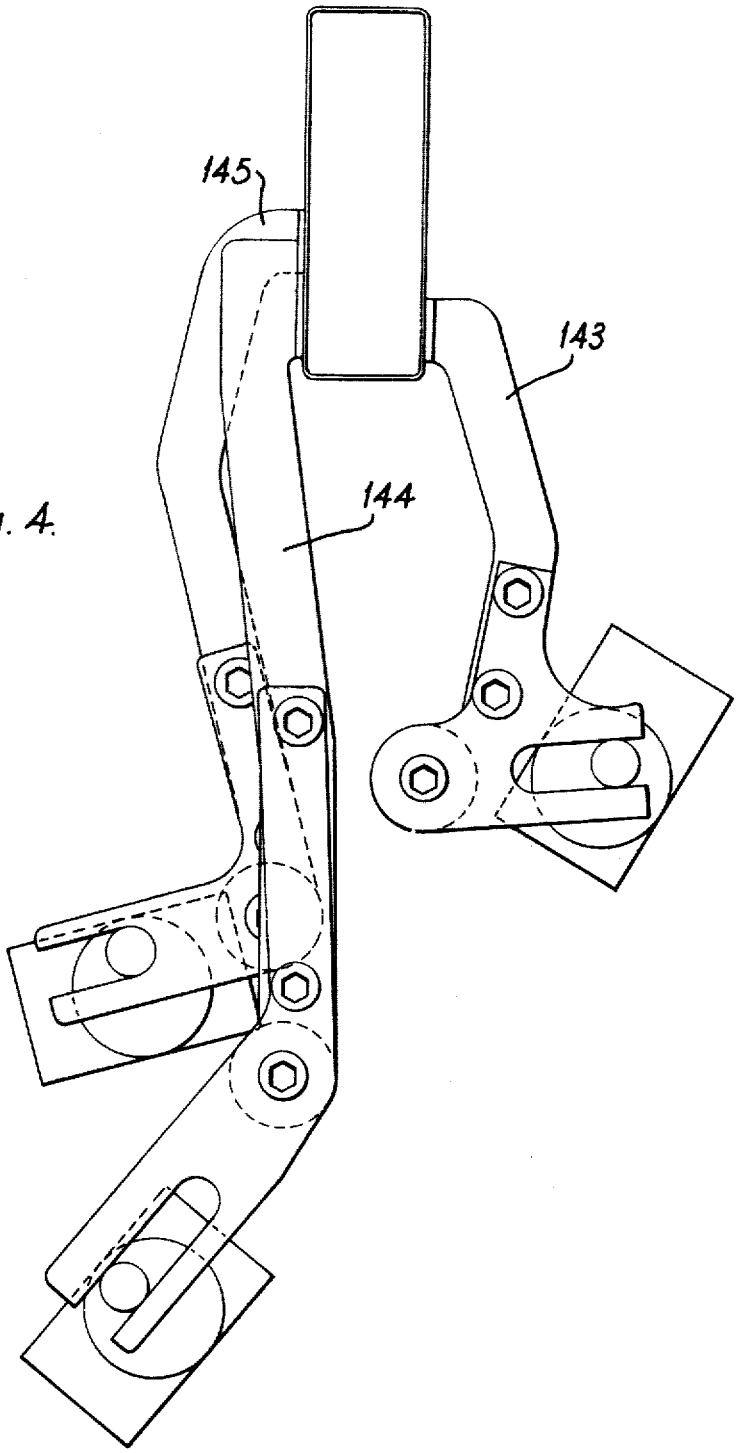

Reference has been made above to the compression of each group of cigarettes while it is in one of the pockets 131 of the drum 103. FIG. 5 illustrates diagrammatically the means by which this is achieved; each pocket 131 is defined by two L-shaped members 132, 133, the member 132 being fixed (relative to the remainder of drum 103) and the member 133 being movable between the positions indicated in full line and in dashed line, so that the spacing between the two members 132, 133 is altered. The member 133 is in its full-line position when the pocket 131 receives a group of cigarettes, and while the drum is subsequently moving, to bring the pocket to the position at which the cigarettes will be transferred to one of the mandrels 141, the member 133 is moved to the dashed-line position, compressing the cigarette group. This movement of member 133 may be produced in various ways; we prefer to connect said member to a cam follower (not shown) travelling on a fixed cam.

It is noted also that the drum 103 serves to turn each cigarette group into alignment with the mandrel 141 which is to receive it. Each mandrel 141 of rotor 104 has the major axis of its generally rectangular cross-section disposed radially relative to the rotational axis of said rotor; each pocket 121 on drum 102 is tilted outwardly on the face of the octagon, specifically at an angle of 3.75° to said face, so the pocket on the trailing portion of one face and the pocket on the leading portion of the next face are at an angle of $(135°+3.75°+3.75°)=142.5°$ to one another. The cigarette groups from these two pockets are simultaneously removed into chambers 131 of drum 103, and one group is discharged to a mandrel 141 after a single (120°) movement of drum 103, the other group being discharged after two movements (total=240°) of drum 103. The overall effect on the angular attitude of the groups' major axes is that one group is turned 240° from its starting attitude, the other group starts from an attitude at 142.5° to the former group and is displaced a further 120°, to give a total difference of 262.5° relative to the starting attitude of the first group. At the end of transfer, therefore, the angular attitude of the latter group is at $(262.5°-240°)=22.5°$ to the former, and this is the angular relationship between adjacent mandrels 141, as there are sixteen such mandrels on rotor 104. (Each time the drum 103 stops, two groups are discharged to mandrels 141, but the two groups were not received from pockets 121 at the same time.)

We claim:

1. A packing machine for rod-like articles such as cigarettes, comprising:
   - a hopper for assembling articles into groups, each containing a predetermined number of articles;
   - a rotatable member carrying a plurality of hollow mandrels at regularly-spaced positions around its circumference;
   - means for supplying packet blanks to each of said mandrels in succession and folding said blanks around said mandrels to form open-ended packets;
   - an endless conveyor having a plurality of spaced tubular pockets for transporting groups of articles from the hopper towards the rotatable member; and
   - a rotatable transfer drum for receiving groups two at a time successively from the pockets of the conveyor and inserting said groups two at a time successively into the mandrels, said transfer drum having a plurality of regularly-spaced chambers for carrying said groups;
   - means for intermittently driving said hopper, said rotatable member, said conveyor and said transfer drum so that:

said rotatable member at regular intervals moves through an angle equal to the angular spacing between the centres of adjacent mandrels;

said conveyor advances by a distance equal to twice the distance between the axis of one pocket and the axis of the next adjacent pocket at every second movement of the rotatable member;

said hopper delivers two groups of articles to respective pockets of the conveyor during each stoppage of the conveyor; and said transfer drum is moved through an angle equal to twice the angular spacing between the centres of adjacent chambers for every two movements of said rotatable member.

2. A machine as claimed in claim 1, in which said endless conveyor is a conveyor drum.

3. A machine as claimed in claim 2, in which the conveyor drum and the transfer drum are so arranged that each time they stop, two adjacent chambers of the transfer drum are aligned with two adjacent pockets of the conveyor drum for simultaneous transfer of two groups of articles from the pockets to the chambers, and two further adjacent chambers of the transfer drum are aligned with two adjacent mandrels of the rotatable member for simultaneous transfer of two groups of articles from the chambers to the mandrels.

4. A machine as claimed in claim 3, in which the conveyor drum is of generally octagonal form, two pockets being carried on each face of the octagon.

5. A machine as claimed in claim 4, in which said pockets, said chambers, and said mandrels are each of generally oblong rectangular section and in which said transfer drum has six chambers, the conveyor drum has the larger side of each of its pockets substantially tangentially disposed and tilted at 3.75° relative to the face on which it is carried, such tilt being outwardly directed away from the other pocket on the same face, and the rotatable member has sixteen mandrels each having its larger side radially disposed.

6. A machine as claimed in claim 1 in which the blank supplying means comprises first feed means for supplying sheets of an inner wrapping material to said mandrels successively and second feed means for supplying sheets of an outer wrapping material to each of said mandrels after a sheet of said inner wrapping material has been at least partly folded around the mandrel.

7. A machine as claimed in claim 6, in which one of said feed means comprises means for feeding a wrapping material web from a reel and means for cutting said web at regular intervals to produce successive sheets.

8. A machine as claimed in claim 6, in which one of said feed means comprises a reciprocating feed device arranged to remove a sheet of wrapping material from one stack while the device is moving in one direction and from another stack while the device is moving in the other direction.

9. A machine as claimed in claims 1, 2, 3, 4, 5, 6, 7 or 8, including a further drum arranged to receive open-ended packets each containing a group of articles from the mandrels of the rotatable member and a heater adjacent to said further drum for drying adhesive in said packets, said further drum being intermittently movable and said heater being arranged to move clear of said further drum during each movement of the latter but to move into engagement with packets carried by said further drum when the latter is stopped.

10. A packing machine for rod-like articles such as cigarettes, comprising (a) a rotatable member carrying a plurality of hollow mandrels at regularly spaced positions around its circumference, each mandrel being of oblong rectangular section with its larger side disposed substantially radially of the member;

(b) means for folding blanks around each successive mandrel to form packets open at one end;

(c) a conveyor drum having a plurality of pairs of pockets each for receiving a group of cigarettes, each pocket being of oblong rectangular section with its larger side substantially tangentially disposed with respect to a circle concentric to the axis of said conveyor drum, and said pairs being regularly spaced about the circumference of said drum; and (d) a transfer drum for receiving two groups at a time successively from said pockets of said conveyor drum, transferring said groups to said rotatable member, and inserting groups two at a time successively into said mandrels of said rotatable member, said transfer drum being disposed between said conveyor drum and said member and comprising means defining a plurality of regularly spaced pairs of chambers for carrying said groups, each said chamber being of oblong rectangular section with its larger sides oriented at an angle intermediate a radial and a tangential disposition of said transfer drum;

(e) means for intermittently rotating said rotatable member, conveyor drum and transfer drum about spaced, substantially parallel respective axes, and the geometric arrangement thereof being such that groups are transferred by said transfer drum from said substantially tangential disposition on said conveyor drum to said substantially radial disposition on said rotatable member.

11. A machine as claimed in claim 10, in which each of said chambers of said transfer drum comprises means for compressing a group carried therein.

12. A machine as claimed in claim 11 in which said transfer drum is arranged to transfer groups from two adjacent pockets of said conveyor drum to adjacent chambers of said transfer drum, and to insert groups from two adjacent chambers to adjacent mandrels of said rotatable member.

13. A machine as claimed in claim 10 or claim 12 or claim 11, in which said rotatable member is rotatable in steps corresponding to the spacing between adjacent mandrels, and said conveyor drum and said transfer drum are each rotatable in steps corresponding to twice the spacing between adjacent pockets and adjacent chambers, respectively.

* * * * *